US006596395B1

(12) United States Patent
Muramatsu

(10) Patent No.: US 6,596,395 B1
(45) Date of Patent: Jul. 22, 2003

(54) BALLS OF SINGLE CRYSTAL SILICON AND METHOD OF MAKING THE SAME

(75) Inventor: Katsutoshi Muramatsu, Kuwana (JP)

(73) Assignee: NTN Corporation, Osaka (JP)

( * ) Notice: Subject to any disclaimer, the term of this patent is extended or adjusted under 35 U.S.C. 154(b) by 56 days.

(21) Appl. No.: 09/618,559

(22) Filed: Jul. 18, 2000

(30) Foreign Application Priority Data

Jul. 23, 1999 (JP) ..... 11-208531
Jul. 23, 1999 (JP) ..... 11-208532

(51) Int. Cl.[7] ..... B32B 5/16

(52) U.S. Cl. ..... 428/402; 428/406; 428/446; 428/447; 451/40; 451/50

(58) Field of Search ..... 451/50, 40; 428/402, 428/406, 446, 447

(56) References Cited

U.S. PATENT DOCUMENTS 5,906,535 A * 5/1999 Tonooka et al. ..... 451/50

6,071,179 A * 6/2000 Sakai ..... 451/50

* cited by examiner

*Primary Examiner*—Leszek Kiliman
(74) *Attorney, Agent, or Firm*—Sughrue Mion, PLLC

(57) ABSTRACT

Silicon balls of single crystal silicon for use in semiconductir circuit substrates or the like, which have been lapped to satisfy necessary requirements and a method of making the same. The silicon ball of single crystal silicon is a lapped ball of single crystal silicon having a sphericity of not greater than 0.08 $\mu$m and also having a residue stress layer of not greater than 5 $\mu$m in a depth from a processing surface thereof on one side in negative and positive directions. The method of making the silicon balls makes use of a pair of lapping tables 2 and 3 supported in face-to-face relation with each other. One or both of the lapping tables 2 and 3 is prepared from finely divided abrasive particles hardened by the use of a resinous bonding material. Workpieces W of single crystal silicon are sandwiched between the lapping tables 2 and 3 and are lapped to provide the lapped balls.

11 Claims, 3 Drawing Sheets

Change in Residue Stress in Depthwise Direction from Processing Surface

As measured by Raman Scattering Spectroscopy

BALLS OF SINGLE CRYSTAL SILICON AND METHOD OF MAKING THE SAME

BACKGROUND OF THE INVENTION 1. (Field of the Invention)

The present invention relates to silicon balls used as substrates for semiconductor circuits and solar cells and a method of making such silicon balls.

2. (Description of the Prior Art)

As a semiconductor technology for the next generation, globular silicon semiconductors have recently come to be spotlighted. Globularizing of a conventional plane silicon wafer has an advantage in that the manufacturing cost that is brought about infinite plant and equipment investment can be reduced and that utilization of silicon material can be maximized as a result of the use of a relatively large spherical surface having a large specific surface area.

In order to use globular silicon as a semiconductor circuit substrate, a surface property comparable to the silicon wafer and a high shape precision are required.

However, the globular silicon satisfying such requirements and a practical method of making such globular silicon have not yet been made available.

Silicon balls of single crystal silicon are generally manufactured by a lapping process of lapping workpieces of single crystal silicon to produce lapped balls and a subsequent finishing process for finishing the lapped balls, that is, a polishing process of polishing the lapped balls to produce the polished balls.

A first problem inherent in the lapping process and associated with the lapped balls will be discussed.

To increase the shape precision of a globular body, a grinding is generally performed. However, processing of silicon balls with the use of a generally utilized metal grinder for cast iron or carbon steel, no surface roughness will be improved even though very finely divided abrasive particles are used. The reason therefor appears to result from that in the practice of the metal grinding process, silicon balls tend to receive a relatively large processing force from the grinder and the abrasive particles and that the silicon balls tend to be agglutinated.

To alleviate the foregoing problems, the inventors of the present invention have suggested a lapping process using an alkaline solution and a lapping process using a resinous material for a material of the surface plate. However, even with these suggested methods, a sufficient shape precision and a sufficient surface property have not yet been attained.

More specifically, although the processing with the use of the alkaline solution utilizes a dissolution, a chemical reaction takes place uniformly on the workpieces and; therefore, compensation for shape is limited. Also, the surface roughness to be controlled by the alkaline concentration is limited and, while the solution concentration has to be lowered to secure a minute surface roughness, virtually no processing proceeds if the concentration is lowered to a certain extent.

In the case of the use of the resinous surface plates, since the processing force which the silicone balls receive from the surface plate and/or the abrasive particles embedded therein is lessened as a result of elastic deformation of the resin, and since no agglutination occur between the workpieces and the surface plate without strongly impairing the surface of the balls, improvement in surface roughness can be expected. However, the extent to which the shape precision can be increased is limited because of the elastic deformation of the resin. Also, the use of very finely divided grinding particles for the purpose of securing a minute surface roughness will result in malfunction of the grinding particles during the processing and, as a result thereof, virtually no processing proceeds.

Also, in order to secure the surface property comparable to the silicon wafer, it is necessary that after the lapping, polishing is carried out to improve the surface roughness and, at the same time, to remove crystal strains and residue stresses brought about by the lapping process. However, with the previously described lapping method, the crystal strains and the residue stresses are so large that a relatively large machining allowance is required during the polishing process and this tends to constitute a cause of shape deterioration after the polishing process.

In other words, while an objective of the polishing process that is effected subsequent to the lapping process is to remove flaws and a residue stress layer resulting from the lapping process, to thereby provide a surface free from crystal flaws and residue stresses, the polishing process in which CMP (chemical machine polishing) is utilized involves a first problem in which because of difference in chemical action due to crystalline orientation, the shape precision such as a sphericity tends to degrade.

A second problem inherent in the polishing process and associated with the polished balls will now be discussed.

In the manufacture of the silicon wafer, polishing is generally performed as a final process so that the silicon wafer can be finished to have a surface having a surface roughness not greater than, for example, 5 angstrom and free from crystal strains. Where silicon balls are to be used as semiconductors, as discussed hereinbefore, the surface property comparable to the silicon wafer and the high shape precision are required.

In the case of the silicon balls, although the processing using the surface plates is most suited for the production of highly accurate balls, this method in which abrasive particles are used to achieve a mechanical grinding is ineffective to remove minute surface flaws and processing strains at a final stage and, therefore, the polishing is essential as a final process.

However, no polished balls of single crystal silicon that can be used as such semiconductor circuit substrates or the like have not yet been made available.

As a method of polishing the silicone balls, a method is known in which the workpieces are retained by a resinous retainer and are polished by a cloth of a kind generally used for polishing wafers. However, this method is susceptible to degradation of the shape, and the workpieces have to be supported in individually separated fashion, resulting in reduction in productivity.

The polishing is a method of grinding performed by the utilization of a chemical action without accompanying strains and residue stresses generated. However, where the workpieces to be processed is globular, processing of the workpieces while the latter are sandwiched between opposed flat polishing clothes tends to result in failure of a function of shape retention and, hence, the shape tends to considerably change. Also, the workpiece retainer is required to retain the workpieces and the workpieces are mounted one by one on the workpiece retained, resulting in reduction in productivity. These are a second problem.

SUMMARY OF THE INVENTION

A primary object of the present invention is to substantially solve the first problem discussed above to thereby provide lapped balls of single crystal silicon that can easily be manufactured so as to satisfy the requirements necessary for them to be used in semiconductor circuit substrate or the like, and also to thereby provide a method of easily making the lapped balls of single crystal silicon that have a required sphericity and a surface property.

Another important object of the present invention is to substantially solve the second problem discussed above to thereby provide polished balls of single crystal silicon of a high productivity that are highly accurate and free from strains and residue stresses in a processed surface and that can be used as semiconductor circuit substrates, solar cells or the like and also to thereby provide a method of making at a high productivity and highly accurately the polished balls of single crystal silicon that are free from strains and residue stresses in the processed surface.

In order to accomplish the foregoing objects, the present invention in one aspect provides a lapped ball of single crystal silicon having a sphericity of not greater than 0.08 μm and also having a residue stress layer of not greater than 5 μm in a depth from a processing surface thereof on one side in negative and positive directions.

The sphericity referred to above is preferably not greater than 0.05 μm and more preferably not greater than 0.03 μm, and the residue stress layer referred to above is preferably not greater than 2.5 μm and more preferably not greater than 1 μm.

The lapped ball of the present invention is, after having been finished by a subsequently performed post process such as, for example, polishing to produce a globular semiconductor circuit substrate, used as a semiconductor circuit element or the like. In the event that the lapped ball fails to satisfy the sphericity of not greater than 0.08 μm during the lapping process, the extent to which the shape degrades after the polishing process would be considerable as compared with the case when the sphericity is good. Also, in the event that the residue stress layer does not satisfy the specific value of 5 μm on one side, the polishing processing time and the polishing mount would increase and, as a result, reduction of the shape precision after the polishing would be considerably as compared with the case in which the residue stress layer satisfies the specific value of 5 μm, The shape precision after the polishing process brings about a considerable influence on an IC manufacturing process that follows. By way of example, because of the bad shape, a beam used during exposure does not focus and, consequently, an integrated circuit will not be formed according to a design pattern, which eventually result in the integrated circuit failing to operate properly. Accordingly, the sphericity and the residue stress layer of the lapped ball, which would bring about influence on the shape precision after the polishing must be properly supervised and, therefore, the foregoing requirements have to be satisfied.

According to another aspect of the present invention, there is provided a method of making lapped balls of single crystal silicon by the use of a pair of lapping tables each prepared by hardening abrasive particles with a resinous bonding material and supported in face-to-face relation with each other, said method comprising a step of lapping workpieces of single crystal silicon between the lapping tables.

Where a surface plate made of abrasive particles hardened with the use of the resinous bonding material is used for each of the lapping tables, the processing with finely divided particles that has not hitherto been achieved with the mere resinous lapping tables can be achieved by fixing the abrasive particles with the use of the resinous bonding material, while securing advantages brought about by the resinous tables which do not result in agglutination with the workpieces. At the same time, since elastic deformation of the polishing tables is minimized, the shape precision can be increased. Also, the processing is possible with the very finely divided abrasive particles, accompanied by reduction in damage to the workpieces and, therefore, the crystal strains and the layer susceptible to the residue stress can be reduced.

In the practice of the present invention, at least one of the lapping tables supported in face-to-face relation with each other preferably has a workpiece rolling groove defined therein for rolling the workpieces of single crystal silicon.

The use of the lapping tables, at least one of which has the workpiece rolling grooves defined therein, is effective to secure the shape precision of the workpieces and the advantage brought about by the use of the lapping tables prepared from a surface plate containing the abrasive particles fixed with the use of the resinous bonding material can be exercised effectively.

According to a further aspect of the present invention, there is provided a polished ball of single crystal silicon having a sphericity of not greater than 0.5 μm and a surface roughness of not greater than 0.5 nmRa and free from crystal strains and residue stresses in a region 3 μm depthwise of a surface layer thereof.

The sphericity referred to above is preferably not greater than 0.3 μm and more preferably not greater than 0.1 μm, and the surface roughness referred to above is preferably not greater than 0.4 mmRa and more preferably not greater than 0.3 mmRa.

Preferably, the polished ball of single crystal silicon is the one obtained by processing the lapped ball of single crystal silicon of the kind described above in accordance with the present invention. The polished ball can be used as a semiconductor circuit substrate, a solar cell or the like as a component itself in the form as produced.

In a process of forming integrated circuits in such a globular element, crystal flaws such as crystal strains and residue stresses and the shape precision of the ball are extremely important.

Where the crystal flaws are present, the crystal flaws brings about a considerably adverse influence on the IC manufacturing process. By way of example, where a film of oxide is to be formed on a surface layer, formation of a film on a defect portion of a surface layer of silicon will become defective and/or an internal portion where crystal flaws are present will result in change in electric characteristic to such an extent as to cause the integrated circuit to operate improperly. Since in the case of the polished ball of single crystal silicon, the crystal flaws are all introduced from a processing surface (a spherical surface) and, therefore, absence of defects on the surface layer can provide an indication that there is no internal crystal flaws inside the ball.

The single crystal silicon has a spacing between the crystalline planes which is 0.54 nm (5.4 angstrom) and, if no flaw is present on the surface, s surface roughness smaller than the spacing between the crystalline planes of the single crystal ought to have been obtained. Accordingly, the polished surface free from surface crystal flaws satisfies the above described specific values (that is, the sphericity of not greater than 0.5 μm and the surface roughness not greater than 0.5 nmRa).

If the sphericity is greater than the above described specific value, that is, 0.5 μm, a considerably adverse influence will be brought about on the IC manufacturing process. By way of example, a beam used during exposure does not focus and, consequently, an integrated circuit will not be formed according to a design pattern, which eventually result in the integrated circuit failing to operate properly.

In view of the foregoing, the polished ball to be used in the semiconductor circuit substrate or the like must satisfy the foregoing requirements in connection with the crystal flaws, the sphericity and the surface roughness, and only when the foregoing requirements are satisfied, it can be used in the semiconductor circuit substrate.

According to a still further aspect of the present invention, there is provided a method of making polished balls of single crystal silicon with the use of a pair of polishing tables, one or both of said polishing tables comprising a polishing cloth and one or both of said polishing tables having a workpiece rolling grooves defined therein, said polishing tables being supported in face-to-face relation with each other, said method comprising polishing workpieces of single crystal silicon between the polishing tables.

According to this polishing method, since the polishing cloth is used, a high surface property comparable to the silicon wafer can be obtained. Also, since one or both of the polishing table are formed with the workpiece rolling groove, any possible degradation of the shape during the processing can be suppressed advantageously, and no workpiece retainer is necessary, resulting in an excellent productivity.

In the practice of the present invention, one of the polishing tables may comprise a polishing cloth and the other of the polishing tables comprise a resinous table.

Even when only one of the polishing table comprises the resinous table, the polished ball comparable to that obtained by the use of the polishing tables each comprising a polishing cloth can be manufactured.

Also, in the practice of the present invention, colloidal silica may be used as a processing fluid, and/or the polishing cloth may be made of foamed polyurethane.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
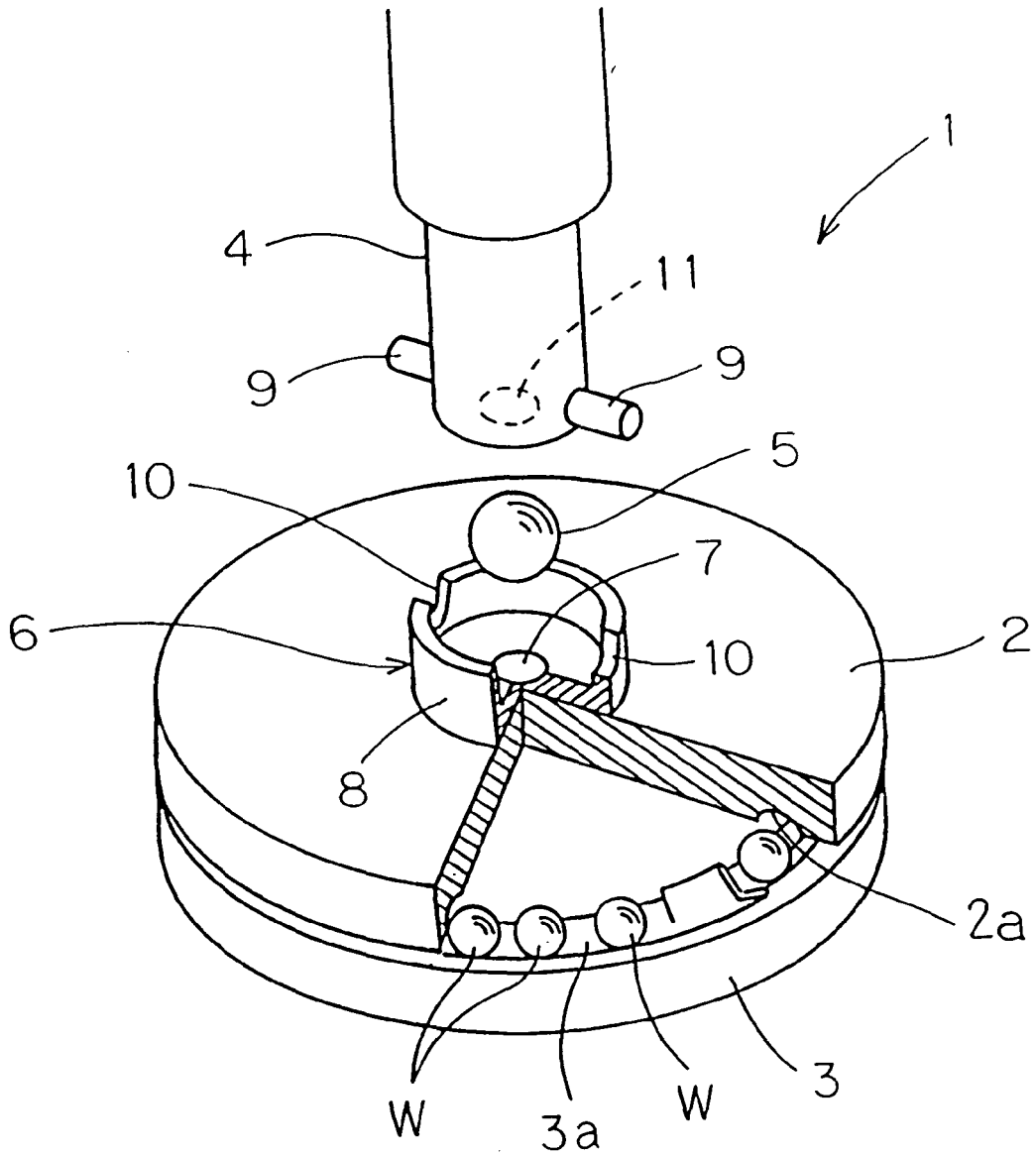
FIG. 1 is a fragmentary perspective view, with a portion cut out, of a grinding machine used in the practice of a method of making lapped balls according to a first embodiment of the present invention.

Referring to FIG. 1 showing a first preferred embodiment of the present invention, there is shown, in a perspective view with a portion cut out, a portion of a grinding machine 1 that can be used in the practice of a method of making lapped balls in accordance with the present invention. The grinding machine 1 is a vertical double-face lapping machine including disc-shaped upper and lower lapping tables 2 and 3 adapted to sandwich a plurality of silicone balls W that are workpieces to be lapped, and a drive shaft 4 adapted to be drivingly coupled with the upper lapping table 2 for rotating the latter relative to the lower lapping table 3. Although not shown, the drive shaft 4 is in turn drivingly coupled with a suitable drive source such as, for example, an electrically operated motor.

Respective working surfaces of the upper and lower lapping tables 2 and 3, which confront with each other, are formed with annular workpiece rolling grooves 2*a* and 3*a* defined therein in concentric relation with each other and, also, with the axis of rotation of the upper lapping table 2, that is, a longitudinal axis of the drive shaft 4. Each of the annular workpiece rolling grooves 2*a* and 3*a* is positioned inwardly adjacent an outer peripheral edge of the respective lapping table 2 or 3 and has a semicircular cross-sectional shape.

Each of the upper and lower lapping tables 2 and 3 is in the form of an abrasive wheel prepared by hardening finely divided abrasive particles by the use of a bonding resin which may be an epoxy resin or the like. The finely divided abrasive particles may be those of alumina, diamond or the like and have an average particle size of, for example, #6,000 to #64,000.

Each of the upper and lower lapping tables 2 and 3 may be in its entirety an abrasive wheel prepared by hardening the finely divided abrasive particles by the use of the bonding resin, or may be an abrasive wheel having only the working surface, or only an annular portion of the working surface where the corresponding workpiece rolling groove 2*a* or 3*a* is formed, bonded with the finely divided abrasive particles by the use of the bonding resin to define an abrasive layer of a predetermined thickness as measured from the working surface thereof. Alternatively, each of the upper and lower lapping tables 2 and 3 may be in the form of an abrasive wheel having the working surface on which an abrasive layer, prepared by hardening the finely divided particles with the use of the bonding resin, firmly secured thereto in any suitable manner.

While the lower lapping table 3 is stationary relative to the upper lapping table 2 that is driven by the drive shaft 4, i.e., supported fixedly on any suitable stationary support, the upper lapping table 3 is adapted to be drivingly coupled with the drive shaft 4 through a universal joint 6. This universal joint 6 comprises a substantially cylindrical coupling wall 8 fixedly mounted on, or otherwise formed integrally with, the surface thereof opposite to the working surface in coaxial relation therewith and having axially extending coupling grooves 10 defined therein and spaced 180° from each other with respect to the axis of rotation of the upper lapping table 2. The universal joint 6 also comprises stud pins 9 connected to, or otherwise formed integrally with, the lower end of the drive shaft 4 so as to extend radially outwardly therefrom and spaced 180° from each other with respect to the longitudinal axis of the drive shaft 4 and engageable in the respective coupling grooves 10 in the coupling wall 8, and a steel ball 5 accommodated within the coupling wall 8 and interposed between the drive shaft 4 and the upper lapping table 2.

To keep the steel ball 5 in position between the drive shaft 4 and the upper lapping table 2, the cylindrical coupling wall 6 has a bottom wall formed with a ball seat 7 concentric with the axis of rotation of the upper lapping table 2 and, on the other hand, a lower end face of the drive shaft 4 is formed with an axially inwardly recessed ball seat 11. The universal joint 6 of the structure described above permits the upper lapping table 2, which substantially lies perpendicular to the drive shaft 4, to fluctuate relative to the drive shaft 4 when the upper table 2 is rotated by the drive shaft.

In the practice of the method of making lapped balls according to the first embodiment of the present invention, the grinding machine 1 of the design discussed above is employed with a plurality of silicon balls W sandwiched between the upper and lower lapping tables 2 and 3, having been received in part within the workpiece rolling groove 3*a* in the lower lapping table 3 and in part within the workpiece rolling groove 2*a* in the upper lapping table 2 as shown in FIG. 1. While the silicon balls W are applied a predetermined load, the drive shaft 4 having been coupled with the upper lapping table 2 through the universal joint 6 is driven to rotate the upper lapping table 2 relative to the lower lapping table 3 to thereby perform a lapping operation subject to the silicon balls W. During the lapping operation, a machining fluid such as, for example, a white kerosene is utilized.

Figure 4:
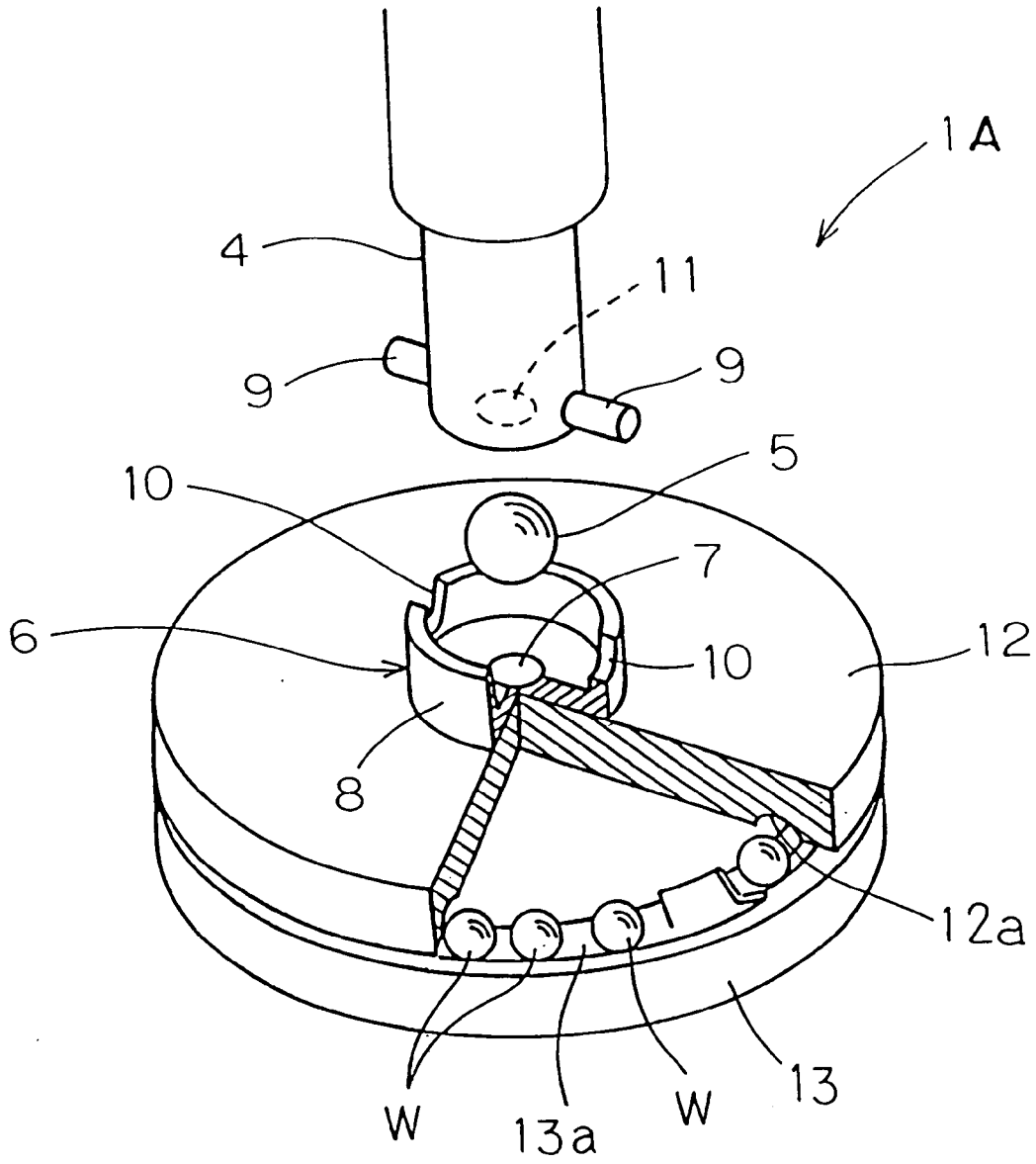
FIG. 4 is a fragmentary perspective view, with a portion cut out, of the grinding machine used in the practice of a method of making polished balls according to a second preferred embodiment of the present invention.

Referring to FIG. 4 showing a second preferred embodiment of the present invention, there is shown, in a perspective view with a portion cut out, a portion of a grinding machine 1A that can be used in the practice of a method of making polished balls in accordance with the present invention. The grinding machine IA is a vertical double-face polishing machine including disc-shaped upper and lower polishing tables 12 and 13 adapted to sandwich a plurality of silicone balls W that are workpieces to be polished, and a drive shaft 4 adapted to be drivingly coupled with the upper polishing table 12 for rotating the latter relative to the lower polishing table 13. Although not shown, the drive shaft 4 is in turn drivingly coupled with a suitable drive source such as, for example, an electrically operated motor.

Respective working surfaces of the upper and lower polishing tables 12 and 13, which confront with each other, are formed with annular workpiece rolling grooves 12*a* and 13*a* defined therein in concentric relation with each other and, also, with the axis of rotation of the upper polishing table 12, that is, a longitudinal axis of the drive shaft 4. Each of the annular workpiece rolling grooves 12*a* and 13*a* is positioned inwardly adjacent an outer peripheral edge of the respective polishing table 12 or 13 and may have a semicircular cross-sectional shape or a generally V-sectioned shape. Although in the foregoing description, the upper and lower polishing tables 12 and 13 have their respective workpiece rolling grooves 12*a* and 13*a* defined therein, one of the upper and lower polishing tables 12 and 13 may have no workpiece rolling grooves and may therefore have a flat working surface.

The upper and lower polishing tables 12 and 13 are in the form of a polishing cloth which may be, for example, a cloth of foamed polyurethane. It is, however, to be noted that instead of the use of the polishing cloth for each of the upper and lower polishing tables 12 and 13, one of the upper and lower polishing tables 12 and 13 may be in the form of a resinous table and, in such case, the other of the upper and lower polishing tables 12 and 13 is in the form of the polishing cloth. Other component parts of the machine are substantially similar to those shown in FIG. 1 and, therefore, the details thereof are not reiterated for the sake of brevity.

In the practice of the method of making polished balls according to the second embodiment of the present invention, the grinding machine 1A of the design discussed above is employed with a plurality of silicon balls W sandwiched between the upper and lower polishing tables 12 and 13, having been received in part within the workpiece rolling groove 13*a* in the lower polishing table 13 and in part within the workpiece rolling groove 12*a* in the upper polishing table 12 as shown in FIG. 4. While the silicon balls W are applied a predetermined load, the drive shaft 4 having been coupled with the upper polishing table 12 through the universal joint 6 is driven to rotate the upper polishing table 12 relative to the lower polishing table 13 to thereby perform a polishing operation subject to the silicon balls W. During the polishing operation, a machining fluid such as, for example, colloidal silica is utilized.

Hereinafter, the present invention will be demonstrated by way of examples which are not intended to limit the scope of the present invention, but are only for the purpose of illustration.

EXAMPLES

Using the method of making the lapped balls shown in FIG. 1, silicon balls W having a sphericity of about 0.5 $\mu$m and a surface roughness of 0.2 $\mu$mRa were lapped. The lapping tables 2 and 3 shown in FIG. 1 are of a structure in which all of the silicon ball retaining grooves 2*a* and 3*a*, between which the silicon balls W undergo a rolling motion, are of a semispherical cross-section, and during the lapping operation, the machining fluid employed was a white kerosene. The amount of each silicon ball lapped, in terms of the difference between the original diameter of each silicon ball and the diameter of such silicon ball after having been lapped, was about 5 $\mu$m.

Respective results of Examples 1 to 4 according to the present invention and respective results of lapping experiments for Comparisons 1 and 2 are tabulated in Table 1. As shown in Table 1, the finely divided abrasive particles employed to provide the upper and lower lapping tables 2 and 3 were alumina particles of #6,000 in particle size in Example 1; diamond particles of #6,000 in particle size in Example 2, diamond particles of #10,000 in particle size in Example, 3; and diamond particles of #64,000 in particle size in Example 4.

TABLE 1

| | Abrasive Particles & Particle Size | Sphericity ($\mu$m) | Surface Roughness (nmRa) | Lapping Speed ($\mu$m/h) |
|---|---|---|---|---|
| Expl. 1 | Alumina #6000 Hardened | 0.08 | 7.8 | 0.5 |
| Expl. 2 | Diamond #6000 Hardened | 0.07 | 6.5 | 0.9 |
| Expl. 3 | Diamond #10000 Hardened | 0.05 | 2.4 | 0.1 |
| Expl. 4 | Diamond #64000 Hardened | 0.03 | 0.9 | 0.04 |
| Comp. 1 | Bakelite Table + Alumina #6000 | 0.15 | 13 | 0.5 |
| Comp. 1 | Bakelite Table + Diamond #10000 | Unable to lap | | |

In all of Examples 1 to 4 and Comparisons 1 and 2, the upper lapping table 2 was driven so that the peripheral velocity of the silicon ball retaining groove 2*a* attained 15 m/min.

As can be understood from Table 1 above, the use of the lapping tables prepared from the resin hardened abrasive particles has exhibited a considerable improvement in sphericity and surface roughness as compared with the use of the resinous tables (bakelite tables coated with the abrasive particles) in each of Comparisons 1 and 2. The lapping speed was higher with the diamond particles than with the alumina particles. Also, when the abrasive particles are extremely fine (#1,000 or higher), the use of the resinous tables in Comparison 2 was virtually ineffective to lap, whereas the use of the lapping tables prepared from the resin hardened abrasive particles was, even though the abrasive particle size was #64,000, effective to achieve a satisfactory lapping with the sphericity and the surface roughness improved sufficiently.

Figure 2:
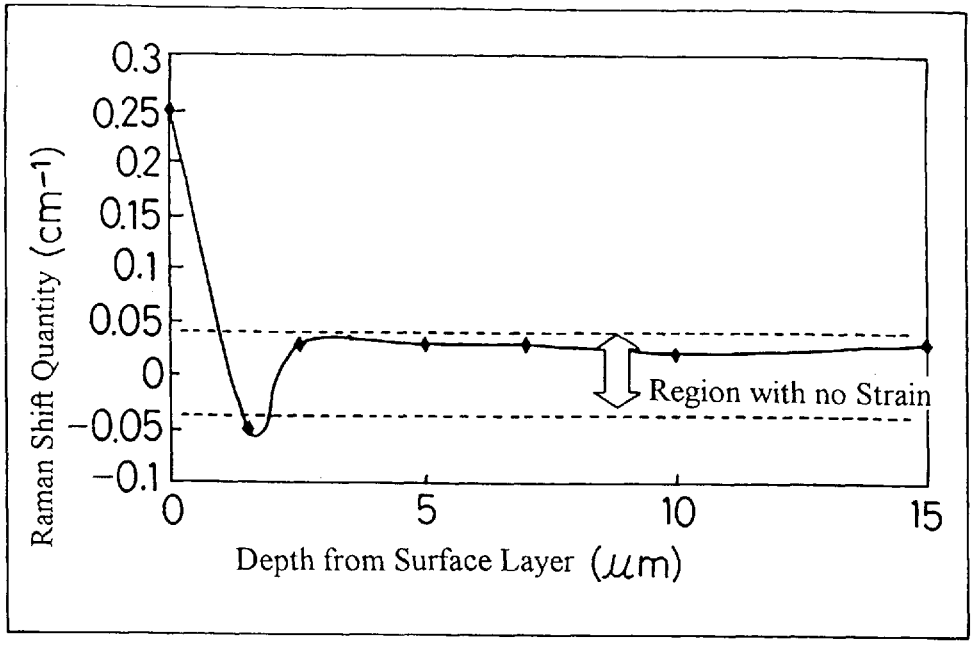
FIG. 2 is a graph showing the relationship between the depth of a machining surface and the residual stress in a lapped ball, as measured by the Raman scattering spectroscopy.

Change in residual stress in a direction depthwise from the lapping surface, as measured by Raman scattering spectroscopy is shown in the graph of FIG. 2. From the result of the Raman scattering spectroscopic analysis, it can be readily understood that the depth of a residual stress layer in each of the lapped silicon ball prepared in each of Examples 1 to 4 of the present invention is not greater than about 5 μm on each side in positive and negative directions.

The foregoing experiments have revealed:

(1) the use of the lapping tables prepared by hardening the finely divided abrasive particles with the use of the resinous bonding material is effective to manufacture the lapped silicon balls having a highly accurate sphericity of not greater than 0.08 μm;

(2) the use of the lapping tables prepared by hardening the finely divided abrasive particles with the use of the resinous bonding material is effective to allow the silicon balls to be lapped with extremely fine abrasive particles (#10,000 or higher) and, hence, to manufacture the lapped silicon balls having a surface roughness not greater than 3 nmRa; and (3) the use of the lapping tables prepared by hardening the finely divided abrasive particles with the use of the resinous bonding material results in the residual stress layer in each lapped ball having a depth of not greater than 5 μm on each side in the positive and negative directions.

Using the vertical polishing machine of the structure shown in FIG. 4, the lapped silicon balls W having a sphericity of about 0.05 μm, a surface roughness of 2 μmRa and a depth of a processed strain being not greater than 5 μm on each of positive and negative sides were polished.

As shown in Tables 2 and 3 below, in Examples 5 to 10 and Comparison 3, the polishing cloth was used for the upper and lower polishing tables 12 and 13 shown in FIG. 14. In Examples 11 to 14, the polishing cloth was used for the upper polishing table 12 and a resinous table POM (Poly Oxy Methylene) was used for the lower polishing table 13. The polishing cloth employed was a sheet of foamed polyurethane.

TABLE 2

Processing Experiments with Double-faced Polishing Cloths

| | Table Type | Processing Load (g/unit) | Sphericity (μm) | Surface Roughness (nmRa) | Processing Speed (μm/h) |
|---|---|---|---|---|---|
| Expl. 5 | Table 12: F, Table 13: R | 20 | 0.15 | 0.35 | 0.82 |
| Expl. 6 | Table 12: F, Table 13: R | 40 | 0.34 | 0.38 | 1.28 |
| Expl. 7 | Table 12: F, Table 13: R | 60 | 0.46 | 0.43 | 1.75 |
| Expl. 8 | Table 12: F, Table 13: V | 20 | 0.14 | 0.36 | 0.78 |

TABLE 2-continued

Processing Experiments with Double-faced Polishing Cloths

| | Table Type | Processing Load (g/unit) | Sphericity (μm) | Surface Roughness (nmRa) | Processing Speed (μm/h) |
|---|---|---|---|---|---|
| Expl. 9 | Table 12: F, Table 13: R | 20 | 0.16 | 0.32 | 0.88 |
| Expl. 10 | Table 12: F, Table 13: V | 20 | 0.18 | 0.37 | 1.02 |
| Comp. 3 | Table 12: F, Table 13: F | 20 | 0.72 | 0.43 | — |

Note: In Table 2, "F" denotes the flat working surface, and "R" denotes the semispherical cross-sectioned groove, and "V" denotes the V-sectioned groove.

Polishing Table: Polishing cloth (Foamed polyurethane)

Groove Peripheral Velocity: 10 m/min (except for Comparison 3)

Machining Fluid: Colloidal silica

TABLE 3

Processing Experiments with Single-faced Polishing Cloth

| | | | | | |
|---|---|---|---|---|---|
| Expl. 11 | Table 12: F, Table 13: R | 20 | 0.11 | 0.29 | 0.46 |
| Expl. 12 | Table 12: F, Table 13: V | 20 | 0.13 | 0.31 | 0.53 |
| Expl. 13 | Table 12: R, Table 13: R | 20 | 0.09 | 0.25 | 0.51 |
| Expl. 14 | Table 12: V, Table 13: V | 20 | 0.11 | 0.29 | 0.64 |

Note: In Table 2, "F" denotes the flat working surface, and "R" denotes the semispherical cross-sectioned groove, and "V" denotes the V-sectioned groove.

Upper Polishing Table: Polishing cloth (Foamed polyurethane)

Lower Polishing Table: Resinous table POM (Poly Oxy Methylene)

Groove Peripheral Velocity: 10 m/min

Machining Fluid: Colloidal silica

As shown in Tables 2 and 3:

In Example 5: The upper polishing table 12 had a flat working surface and the lower polishing table 13 had a semispherical cross-sectioned groove on its working surface.

In Example 6: The upper polishing table 12 had a flat working surface and the lower polishing table 13 had a semispherical cross-sectioned groove on its working surface.

In Example 7: The upper polishing table 12 had a flat working surface and the lower polishing table 13 had a semispherical cross-sectioned groove on its working surface.

In Example 8: The upper polishing table 12 had a flat working surface and the lower polishing table 13 had a V-sectioned groove on its working surface.

In Example 9: The upper polishing table 12 had a semispherical cross-sectioned groove on its working surface and the lower polishing table 13 had a semispherical cross-sectioned groove on its flat working surface.

In Example 10: The upper polishing table 12 had a V-sectioned groove on its working surface and the lower polishing table 13 had a semispherical cross-sectioned groove on its working surface.

In Comparison 3: The upper polishing table 12 had a flat working surface and the lower polishing table 13 had a flat working surface.

In Example 11: The upper polishing table 12 had a flat working surface and the lower polishing table 13 had a semispherical cross-sectioned groove on its working surface.

In Example 12: The upper polishing table 12 had a flat working surface and the lower polishing table 13 had a V-sectioned groove on its working surface.

In Example 13: The upper polishing table 12 had a semispherical cross-sectioned groove on its flat working surface and the lower polishing table 13 had a semispherical cross-sectioned groove on its working surface.

In Example 14: The upper polishing table 12 had a V-sectioned groove on its flat working surface and the lower polishing table 13 had a V-sectioned groove on its working surface.

The amount of each lapped silicon ball processed, in terms of the difference between the original diameter of each lapped silicon ball and the diameter of such lapped silicon ball after having been polished, was about 10 $\mu$m.

In Comparison 3, a resinous retainer was used for retaining the silicon balls which were workpieces to be processed.

Also, to examine the strain on the surface of the processed workpieces and the residue stress, the Raman scattering spectroscopy was used. With this spectroscopy, measurement of the residue stress and the crystal stress of about 3 $\mu$m beneath the surface layer is possible. The result of the Raman scattering spectroscopic analysis is tabulated in Table 4 below.

TABLE 4

Raman Scattering Spectroscopic Measurement of Strains and Residue Stresses

| | Displacement from Reference Si Raman Shift Quantity ($cm^{-1}$) | Presence or Absence of Strains |
|---|---|---|
| Expl. 5 | 0.035 | Absent |
| Expl. 6 | 0.038 | Absent |
| Expl. 7 | 0.041 | Absent |
| Expl. 8 | 0.042 | Absent |
| Expl. 9 | 0.019 | Absent |
| Expl. 10 | 0.036 | Absent |
| Expl. 11 | 0.027 | Absent |
| Expl. 12 | 0.034 | Absent |
| Expl. 13 | 0.035 | Absent |
| Expl. 14 | 0.026 | Absent |

The strains are determined absent when the displacement of the Raman shift amount from the reference Si is not greater than 0.05 $cm^{-1}$ (corresponding to the measurement tolerance).

(1) The polishing with the use of the polishing cloth on both sides and the workpiece rolling groove on at least one side is effective to manufacture polished silicon free from crystal strains and residue stresses in the surface layer of 3 $\mu$m, having a sphericity of not greater than 0.5 $\mu$m and a surface roughness not greater than 0.5 nmRa.

(2) Even when the one of the tables is replaced with the resinous table in (2) above, the polished balls comparable to them can be manufactured effectively.

Table 5 shown below illustrates the relationship between the sphericity of the lapped balls and that of the polished balls

TABLE 5

Relationship between Sphericity of Lapped Balls and Sphericity of Polished Balls

| Sphericity ($\mu$m) | | |
|---|---|---|
| After Lapping | After 10 $\mu$m Polished | After 14 $\mu$m Polished |
| 0.05 | 0.18 | 0.56 |
| 0.08 | 0.44 | 0.92 |
| 0.12 | 0.95 | 1.78 |
| 0.15 | 1.62 | 2.63 |

Figure 3:
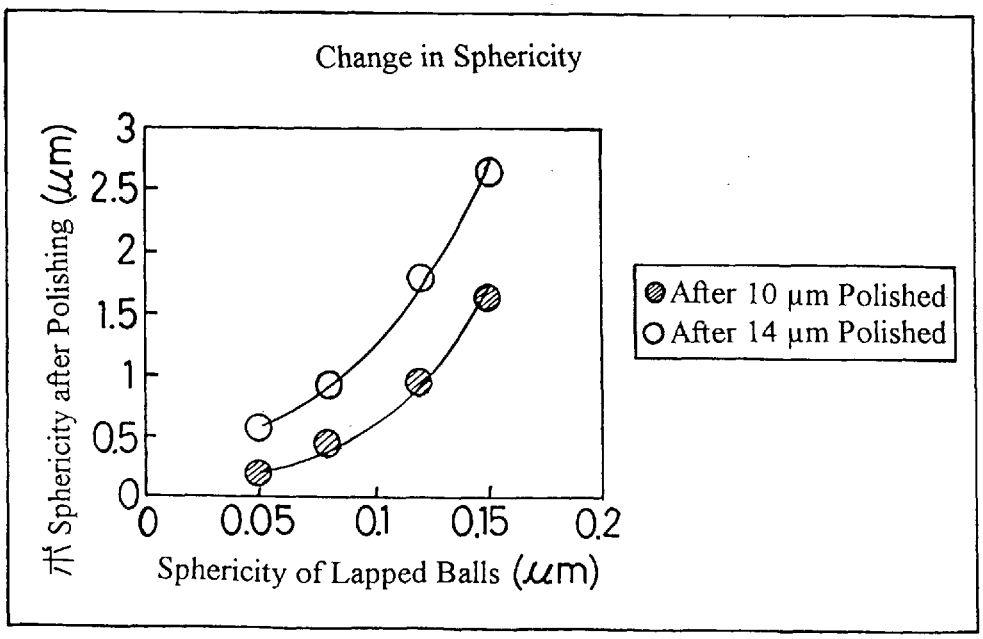
FIG. 3 is a graph showing the relationship between the sphericity of the lapped ball of single crystal silicon and the sphericity of the ball that has been polished.

The numeric values descriptive of the relationship shown in Table 3 are plotted in the graph of FIG. 3.

As can be understood from Table 5 or the graph of FIG. 3, the greater the sphericity of the lapped ball, the greater the sphericity of the balls after having been polished regardless of the amount of the balls polished.

Table 6 shown below illustrates the relationship between the accuracy of the polished balls and semiconductor circuit elements that can be fabricated.

TABLE 6

Relationship Between the Polished Ball Accuracy and Semiconductor Circuit Elements

| Polished Ball | | | | Semiconductor Circuit Elements | | | |
|---|---|---|---|---|---|---|---|
| No. | Sphericity ($\mu$m) | Surface Roughness (nmRa) | Flaws in Surface Layer | Diode | Transistor | CMOS Logic | Non-volatile Memory |
| 1 | 0.2 | ≦0.5 | Not found | O | O | O | X |
| 2 | 0.2 | 0.35 | Found | X | X | X | X |
| 3 | 0.5 | 0.43 | Not found | O | O | O | Δ |
| 4 | 0.5 | 0.46 | Found | X | X | X | X |
| 5 | 0.5 | 0.72 | Found | O | X | X | X |
| 6 | 0.8 | 0.38 | Not found | O | O | Δ | X |
| 7 | 0.8 | 0.32 | Found | X | X | X | X |
| 8 | 0.8 | 0.68 | Found | X | X | X | X |
| 9 | 1.2 | 0.43 | Not found | O | Δ | Δ | X |

Note:
O: The circuit element can be formed all over the spherical surface.
Δ: The circuit element can be partially formed over the spherical surface.
X: No circuit element can be formed.

In Table 6 above, No. 1 describes on a computer-simulated predication whereas others describe respective predications based on experimental data. From Table 3, it will readily be seen that that provided that no flaw is found in the surface layer, diodes, transistors, CMOS (complementary metal oxide semiconductor) logic circuits and non-volatile memories can be formed all over the spherical surface of the silicon balls of silicon if the sphericity after polishing is 0.2 μm; diodes, transistors and CMOS logic circuits can be formed all over the spherical surface of the silicon balls and non-volatile memories can be partly formed over the spherical surface of the silicon balls if the sphericity after polishing is 0.5 μm; and diodes and transistors can be formed all over the spherical surface of the silicon balls, CMOS logic circuit can be formed over only a portion of the spherical surface of the silicon balls, and non-volatile memories cannot be formed over the silicon balls, if the sphericity after polishing is 0.8 μm. If the sphericity is unacceptable, say, 1.2 μm, diodes can be formed all over the spherical surface of the silicon ball, but transistors can be formed over only a portion of the spherical surface of the silicon balls and neither CMOS logic circuits nor non-volatile memory can be formed on the silicon balls.

Comparing Tables 6 and 5 with each other, it will readily be seen that in order to obtain the silicon balls of silicon after having been polished, which can be used for formation of transistors all over the spherical surface thereof and for formation of CMOS logic circuits over a portion of the spherical surface thereof, the sphericity of the lapped ball should be not greater than 0.08 μm.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A lapped ball of single crystal silicon having a sphericity of not greater than 0.08 μm and also having a residue stress layer of not greater than 5 μm in depth.

2. A method of making lapped balls of single crystal silicon by the use of a pair of lapping tables each prepared by hardening abrasive particles with a resinous bonding material and supported in face-to-face relation with each other, said method comprising a step of lapping workpieces of single crystal silicon between the lapping tables, to produce a single crystal silicon ball substantially free from crystal strain and residue stress in a region 3 μm depthwise of a surface layer thereof.

3. The method of making the lapped balls of single crystal silicon as claimed in claim 2, wherein at least one of the lapping tables supported in face-to-face relation with each other has a workpiece rolling groove defined therein for rolling the workpieces of single crystal silicon.

4. A polished ball of single crystal silicon having a sphericity of not greater than 0.5 μm and a surface roughness of not greater than 0.5 nmRa and free from crystal strains and residue stresses in a region 3 μm depthwise of a surface layer thereof.

5. A polished ball of single crystal silicon which is obtained by processing a lapped ball of single crystal silicon as defined in claim 1, said polished ball having a sphericity of not greater than 0.5 μm and a surface roughness of not greater than 0.5 nmRa.

6. A method of making polished balls of single crystal silicon with the use of a pair of polishing tables, one or both of said polishing tables comprising a polishing cloth and one or both of said polishing tables having a workpiece rolling grooves defined therein, said polishing tables being supported in face-to-face relation with each other, said method comprising polishing workpieces of single crystal silicon between the polishing tables, to produce a single crystal silicon ball substantially free from crystal strain and residue stress in a region 3 μm depthwise of a surface layer thereof.

7. A method of making polished balls of single crystal silicon with the use of a pair of polishing tables, one of said polishing tables comprising a polishing cloth and the other of said polishing tables comprising a resinous table, one or both of said polishing tables having a workpiece rolling grooves defined therein, said polishing tables being supported in face-to-face relation with each other, said method comprising polishing workpieces of single crystal silicon between the polishing tables, to produce a single crystal silicon ball substantially free from crystal strain and residue stress in a region 3 μm depthwise of a surface layer thereof.

8. The method of making the polished balls of single crystal silicon as claimed in claim 6 or 7, wherein colloidal silica is used as a processing fluid.

9. The method of making the polished balls of single crystal silicon as claimed in claim 1, wherein the polishing cloth is made of foamed polyurethane.

10. The method of making the polished balls of single crystal silicon as claimed in claim 7, wherein the polishing cloth is made of foamed polyurethane.

11. The method of making the polished balls of single crystal silicon as claimed in claim 8, wherein the polishing cloth is made of foamed polyurethane.

* * * * *